US005679629A

United States Patent [19]

Kubota et al.

[11] Patent Number: 5,679,629

[45] Date of Patent: Oct. 21, 1997

[54] DETERGENT COMPOSITION FOR HARD SURFACES

[75] Inventors: Masakazu Kubota; Norikazu Jin; Kazunori Tsukuda, all of Tochigi; Hiroshi Nagumo, Wakayama, all of Japan

[73] Assignee: Kao Corporation, Tokyo, Japan

[21] Appl. No.: 448,608

[22] PCT Filed: Oct. 13, 1994

[86] PCT No.: PCT/JP94/01717

§ 371 Date: Jul. 27, 1995

§ 102(e) Date: Jul. 27, 1995

[87] PCT Pub. No.: WO95/10587

PCT Pub. Date: Apr. 20, 1995

[30] Foreign Application Priority Data

Oct. 14, 1993 [JP] Japan ..... 5-257203
Feb. 2, 1994 [JP] Japan ..... 6-011175

[51] Int. Cl.[6] ..... C11D 1/70; C11D 1/75; C11D 3/22

[52] U.S. Cl. ..... 510/197; 510/218; 510/365; 510/422; 510/470; 510/506

[58] Field of Search ..... 252/174.21, 174.22, 252/156, 548; 510/197, 218, 365, 422, 470, 506

[56] References Cited

U.S. PATENT DOCUMENTS

| | | | |
|---|---|---|---|
| 2,889,297 | 6/1959 | Brandner et al. | 260/29.6 |
| 3,829,387 | 8/1974 | Wise et al. | 252/156 |
| 4,233,174 | 11/1980 | Sheridan | 252/170 |

FOREIGN PATENT DOCUMENTS

| | | |
|---|---|---|
| 51-10808 | 1/1976 | Japan . |
| 1236300 | 9/1989 | Japan . |
| 2274800 | 8/1990 | Japan . |
| 2012804 | 8/1979 | United Kingdom . |

*Primary Examiner*—Paul Lieberman
*Assistant Examiner*—Charles Boyer
*Attorney, Agent, or Firm*—Birch, Stewart, Kolasch & Birch, LLP

[57] ABSTRACT

A detergent composition for hard surfaces is disclosed, which contains: (a) a mixture consisting of at least two compounds represented by formula (I), wherein s is an integer from 1 to 10, representing the number of moles of the ethylene oxide group, which are different in degree of polymerization, said mixture (a) satisfying relationship (1), wherein $N_t$ is the percent by weight of a compound having t mol of the oxyethylene group added based on the weight of mixture (a). The detergent composition has excellent detergency and foaming properties and is useful for removal of denatured oily dirt in the kitchen.

6 Claims, No Drawings

DETERGENT COMPOSITION FOR HARD SURFACES

FIELD OF THE INVENTION

This invention relates to a detergent composition for a hard surface and more particularly a detergent composition having excellent foaming properties which effectively, safely and rapidly removes clinging dirt, such as greasy dirt on tiles, enameled ironware, etc. in a kitchen that is the cooking oil splashed during cooking and denatured with heat or time.

BACKGROUND OF THE INVENTION

A ventilator, a stove, etc. in the kitchen of homes easily get greasy with an oily and sticky substance that is difficult to remove. This oily dirt is denatured cooking oil which has splashed or smoked during deep-frying or shallow-frying and stuck to the surface of the ventilator, the stove, etc. In general, many kinds of cooking oil have a chemical structure containing an unsaturated double bond. Such oil easily undergoes oxidation or polymerization on exposure to air for a long time under action of heat or light to gradually increase its molecular weight into resinous matter. This is the substance of the denatured oily dirt which is the cause of difficulty in cleaning the kitchen.

The ventilator in homes, if left uncleaned, gets stained with a notable amount of oily dirt and becomes unsightly in about 6 months. By that time, the adhered oil has undergone considerable denaturation with strong adhesion to the substrate, turning into heavy dirt that cannot be easily removed. Detergent compositions containing an alkylene glycol ether type solvent, such as butyl carbitol, have been used for removal of such dirt. However, these detergent compositions were unsatisfactory for their ill smell and insufficient detergent action.

In order to solve the above-described problems, Japanese Patent Application Public Disclosure No. 10808/76 proposes to use hexylene glycol in combination with an alkylene glycol ether solvent to provide a safe detergent composition which has enhanced detergency and is substantially odorless.

Further, Japanese Patent Application Public Disclosure No. 236300/89 discloses a detergent for hard surfaces which contains a polyoxyalkylene monobenzyl ether with the number of moles of the polyoxyalkylene added being not more than 5. According to the description of the publication, this detergent lathers nicely.

However, these conventional detergents are still unsatisfactory in detergency for heavy oily dirt, particularly those denatured under influences of temperature, humidity, and oxygen.

SUMMARY OF THE INVENTION

Accordingly, an object of the present invention is to provide a detergent composition for hard surfaces (hereinafter simply referred to as hard surface detergent composition) which is excellent in swelling properties and detergency for heavy dirt, such as oil denatured under influences of temperature, humidity, oxygen, etc., and is capable of rapid cleansing.

As a result of extensive investigations, the present inventors have found that the above object of the present invention is accomplished by a detergent composition containing a mixture consisting of at least two polyoxyethylene monophenyl ethers different in degree of polymerization at a specific mixing ratio. The present invention has been completed based on this finding.

The present invention provides a hard surface detergent composition containing (a) a mixture consisting of at least two compounds represented by formula (I):

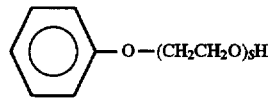

(I)

wherein s is an integer of from 1 to 10, representing the number of moles of the ethylene oxide group, which are different in degree of polymerization, the mixture satisfying relationship (1):

$$99/1 \geqq \sum_{t=1}^{t=3} N_t / \sum_{t=4}^{t=10} N_t \geqq 15/85 \quad (1)$$

wherein Nt is the percent by weight of a compound having t mol of the oxyethylene group added based on the weight of mixture (a).

DETAILED DESCRIPTION OF THE INVENTION

The hard surface detergent composition of the present invention will be illustrated below in greater detail.

The compounds represented by formula (I) which constitute component (a) are polyoxyethylene monophenyl ethers. Component (a) is a mixture of at least two polyoxyethylene monophenyl ethers different in degree of polymerization. From the standpoint of swelling or dissolving action on oily dirt, particularly denatured oily dirt, component (a) should satisfy relationship (1),preferably relationship (2), still preferably relationship (3),yet preferably relationship (4), and most preferably relationship (5):

$$99/1 \geqq \sum_{t=1}^{t=3} N_t / \sum_{t=4}^{t=10} N_t \geqq 15/85 \quad (1)$$

wherein Nt is the percent by weight of a compound having t mol of the oxyethylene group added based on the weight of mixture (a) (hereinafter the same).

$$99/1 \geqq \sum_{t=1}^{t=3} N_t / \sum_{t=4}^{t=6} N_t \geqq 15/85 \quad (2)$$

$$98/2 \geqq \sum_{t=1}^{t=3} N_t / \sum_{t=4}^{t=6} N_t \geqq 15/85 \quad (3)$$

$$95/5 \geqq \sum_{t=1}^{t=3} N_t / \sum_{t=4}^{t=6} N_t \geqq 35/65 \quad (4)$$

$$75/25 \geqq \sum_{t=1}^{t=3} N_t / \sum_{t=4}^{t=6} N_t \geqq 50/50 \quad (5)$$

Further, it is preferable that component (a) satisfying relationship (2), (3), (4) or (5) satisfies relationship (6):

$$\sum_{t=1}^{t=6} N_t \geqq 95 \quad (6)$$

The process for preparing component (a) is not particularly limited. For example, component (a) can be obtained by a process comprising arbitrarily selecting at least one compound of formula (I) in which s is between 1 and 3 and at least one compound of formula (I) in which s is between 4 and 10, preferably between 4 and 6, and mixing them together at such a ratio that satisfies any of relationships (1) to (5), or a process comprising reacting phenol with ethylene oxide in the presence of an alkali catalyst, such as sodium hydroxide or potassium hydroxide.

Component (a) is a mixture of at least two of the above-mentioned polyoxyethylene monophenyl ethers, the two having different degrees of polymerization. While a single compound of formula (I) in which s is from 1 to 3 or from 4 to 10 is expected to exhibit detergent effects on oily dirt or slightly denatured oily dirt, the action of swelling and dissolving denatured oil can be accelerated by mixing a compound in which s is from 1 to 3 and a compound in which s is from 4 to 10, preferably from 4 to 6, at a specific ratio satisfying any of the relationships (1) to (5).

It is preferable that the detergent composition of the present invention further contains (b) an alkali agent (hereinafter referred to as component (b)).

While not limiting, the alkali agent as component (b) preferably includes ammonia and alkanolamines. In particular, monoethanolamine and diethanolamine are preferred for their hydrolytic action on denatured oil, leading enhanced detergency. These alkali agents may be used either individually or in combination of two or more thereof.

Components (a) and (b) are preferably used at a weight ratio of $1/10 \leqq (b)/(a) \leqq 10/1$, particularly $1/10 \leqq (b)/(a) \leqq 1/1$. If the ratio (b)/(a) is less than 1/10, the effect of addition of component (b) is insubstantial. A (b)/(a) ratio greater than 10/1 is uneconomical; for detergency reaches saturation.

If is also preferable that the detergent composition furthermore contains (c) a surface active agent (hereinafter referred to as component (c)). Component (c) imparts satisfactory detergency and foaming properties to the detergent composition. In particular, when the detergent composition is applied by spraying or with a squeeze foamer, component (c) markedly improves retention of the composition, thereby synergistically increasing the swelling action of component (a) on denatured oily dirt.

While not limiting, component (c) preferably includes the following nonionic, amphoteric or anionic surface active agents.

From the viewpoint of detergency, foaming properties, and low irritation, suitable nonionic surface active agents include polyoxyethylene alkyl ethers, polyoxyethylene alkenyl ethers, higher fatty acid alkanolamides, polyoxyethylene higher fatty acid alkanolamides, amine oxides, and alkyl glycosides, with alkyl glycosides being especially preferred. Specific examples of the nonionic surface active agents are polyoxyethylene(p=3) lauryl ether, polyoxyethylene (p=7) lauryl ether, polyoxyethylene(p=12) lauryl ether, dodecyl maltoside, coconut oil fatty acid diethanolamide, polyoxyethylene(p=2) coconut oil fatty acid monoethanolamide, and lauryldimethylamine oxide (p represents an average degree of polymerization). These nonionic surface active agents may be used either individually or in combination of two or more thereof.

From the standpoint of detergency and foaming properties, suitable amphoteric surface active agents include alkylamidocarbobetaines and alkylamidosulfobetaines. Specific examples are lauramidopropyl-N,N-dimethyl-acetic acid betaine, myristamidopropyl-N,N-dimethyl-acetic acid betaine, and cocoamidopropyl-N,N-dimethyl-acetic acid betaine. These amphoteric surface active agents may be used either individually or in combination of two or more thereof.

Suitable anionic surface active agents include alkylbenzenesulfonates, alkylene oxide-added alkyl or alkenyl ether sulfates, olefinsulfonates, alkanesulfonates, saturated or unsaturated fatty acid salts, alkylene oxide-added alkyl or alkenyl ether carboxylates, and α-sulfofatty acid salts or esters. The counter ions forming these salts include alkali metal ions, e.g., a sodium ion and a potassium ion, an ammonium ion, and alkanolammonium ions, e.g., a monoethanolammonium ion, a diethanolammonium ion and a triethanolammonium ion. The anionic surface active agents may be used either individually or in combination of two or more thereof.

The nonionic, amphoteric and anionic surface active agents may be used either individually or in combination thereof.

Of the above-enumerated surface active agents as component (c), preferred are nonionic surface active agents or amphoteric surface active agents, and particularly nonionic surface active agents, with alkyl glyco-sides being most preferred, for their detergency for denatured oily dirt.

The alkyl glycosides which can be used as component (c) preferably include those represented by formula (II):

$$R_2(OR_3)_xG_y \quad \text{(II)}$$

wherein $R_2$ represents an alkyl group, an alkenyl group or an alkylphenyl group each having from 8 to 18 carbon atoms, the alkyl moiety of which may be straight or branched; $R_3$ represents an alkylene group having from 2 to 4 carbon atoms; G represents a residue of a reducing sugar having from 5 to 7 carbon atoms, such as glucose; x represents a number of from 0 to 5 in average; and y represents a number of from 1 to 10 in average.

Water solubility and crystallinity of the alkyl glycoside can be adjusted by varying x in formula (II) between 0 and 5 in average. x is preferably from 0 to 2, still preferably 0. Where y in formula (II) is greater than 1 in average, the sugar chains may be bonded through a 1–2 bond, a 1–3 bond, a 1–4 bond or a 1–6 bond or an α- or β-pyranoside or furanoside linkage or a mixture thereof. y is preferably from 1 to 10, still preferably from 1 to 1.5, yet preferably from 1.1 to 1.4. y can be measured by proton NMR.

$R_2$ in formula (II) is preferably an alkyl group having from 10 to 14 carbon atoms from the standpoint of solubility and detergency. $R_3$ is preferably an alkylene group having 2 or 3 carbon atoms from the standpoint of water solubility. The structure of G is decided by the starting mono-, di- or polysaccharide. The starting material for G preferably includes glucose and fructose as a monosaccharide and maltose and sucrose as a di- or polysaccharide from the standpoint of availability and cost. Glucose is particularly preferred for its availability.

Where an alkyl glycoside (hereinafter referred to as component (c-1)) is used, it is recommended to use it in combination with an amphoteric surface active agent (hereinafter referred to as component (c-2)), preferably an alkylamidocarbobetaine, for improving the quality of lather, such as foaming properties and foam stability. In this case, components (c-1) and (c-2) are preferably used at a (c-1)/(c-2) weight ratio of 1/10 or higher for detergency and not higher than 10/1 for foaming properties, still preferably from 1/8 to 8/1, and yet preferably from 1/5 to 5/1.

It is preferable that components (c) and (b) are used at a (c)/(b) weight ratio of from 1/10 to 10/1, particularly from 1/10 to 1/1. If that ratio is smaller than 1/10, the effect of improving detergency is insubstantial. The (c)/(b) ratio exceeding 10/1 is uneconomical.

The hard surface detergent composition according to the present invention is prepared in a usual manner by mixing the essential component (a), preferably components (a) and (b), still preferably components (a), (b), and (c-1), yet preferably components (a), (b), (c-1), and (c-2), with water (hereinafter referred to as component (d)), if desired together with other optional components hereinafter described, to obtain an aqueous solution.

Component (a) is used in a proportion of from 0.1 to 30 parts by weight, preferably from 1 to 20 parts by weight, still preferably from 3 to 15 parts by weight, per 100 parts by weight of the total weight of components (a) to (d). If the proportion of component (a) is less than 0.1 part, sufficient detergency cannot be obtained. A proportion of higher than 30 parts, at which the effects reach saturation, is uneconomical.

Component (b) is used at a proportion of from 0.01 to 20 parts by weight, preferably from 0.05 to 10 parts by weight, per 100 parts by weight of the total weight of components (a) to (d). If the proportion of component (b) is less than 0.01 part, the detergency tends to be insufficient. A proportion of higher than 20 parts, at which the effects reach saturation, is uneconomical.

Component (c) is used in a proportion of from 0.1 to 20 parts by weight, preferably from 0.1 to 15 parts by weight, more preferably from 1 to 10 parts by weight, per 100 parts by weight of the total weight of components (a) to (d). If the proportion of component (c) is less than 0.1 part, the detergency tends to be insufficient. A proportion higher than 20 parts, at which the effects reach saturation, is uneconomical.

Component (d) is preferably used at a proportion of from 30 to 99.5 parts by weight, still preferably from 75 to 95 parts by weight.

If desired, the hard surface detergent composition of the present invention may contain other optional components, such as a sequestering agent, a low-temperature stabilizer, a viscosity modifier, and the like.

Any of commonly employed sequestering agents may be used in the present invention without restriction. Suitable sequestering agents include hydroxycarboxylic acids, e.g., citric acid and malic acid; condensed phosphoric acids, e.g., pyrophosphoric acid; aminocarboxylic acids, e.g., ethylenediaminetetraacetic acid and hydroxyethylenediamineacetic acid; and alkali meal (Na or K) salts, ammonium salts or alkanolamine salts thereof and their water-soluble salts. These sequestering agents may be used either individually or in combination of two or more thereof. The sequestering agent is used in an amount of from 0.001 to 20 parts by weight per 100 parts by weight of the total weight of components (a) to (d).

Useful low-temperature stabilizers include lower alcohols, e.g., ethyl alcohol; lower glycols, e.g., ethylene glycol; and lower alkylbenzenesulfonates, e.g., benzenesulfonates and toluenesulfonates. The low-temperature stabilizer is usually used in an amount of from 0.1 to 20 parts by weight per 100 parts by weight of the total weight of components (a) to (d).

Useful viscosity modifiers include smectites, acrylic homo- or copolymers, such as sodium polyacrylate, cross-linked polyacrylic acids, and polyalkyl acrylates, polyvinyl alcohol, hydroxyethyl cellulose, carboxymethyl cellulose, polyvinyl pyrrolidone, and maleic anhydride polymers. The viscosity modifier is used in an amount of from 0.1 to 10 parts by weight per 100 parts by weight of the total weight of components (a) to (d).

In order to enhance the commercial value of the detergent composition, the composition may further contain perfumes, colorants, antiseptics, antioxidants, thickeners, and so on.

The hard surface detergent composition according to the present invention can be used, for example, by bringing dirt into contact with the composition for 5 to 30 minutes by, for example, soaking and removing the thus released and floated dirt. The contact time may be extended to 5 to 10 hours for heavy dirt. Where the composition is applied to a slanted or vertical surface, the detergent composition may be foamed and sprayed thereto to assure retention on the surface.

The present invention will now be illustrated in greater detail with reference to Examples in view of Comparative Examples, but it should be understood that the present invention is not deemed to be limited thereto.

EXAMPLES 1 AND COMPARATIVE EXAMPLES 1 TO 7

A detergent composition having the composition shown in Table 1 below (unit: wt %) was prepared and subjected to a swelling test in accordance with the following test method. The results obtained are shown in Table 1.

Swelling Test:

Fourteen milligrams of rapeseed oil were baked on a Teflon-coated plate at 180° C. for 10 hours to prepare a denatured oil cake. The denatured oil cake was soaked in 2 ml of the detergent composition for 5 hours, and the swell (Q) of the cake was obtained as follows.

$$Q = 1 + \frac{D_p}{D_s}\left(\frac{W_b}{W_a} - 1\right)$$

wherein $D_p$ is a density of a denatured oil; $D_s$ is a density of a detergent composition; $W_a$ is a weight of a non-treated denatured oil; and $W_b$ is a weight of a swollen denatured oil.

TABLE 1

| | Example | Comparative Example No. | | | | | | |
|---|---|---|---|---|---|---|---|---|
| | 1 | 1 | 2 | 3 | 4 | 5 | 6 | 7 |
| 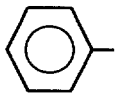 $-O-(CH_2CH_2O)_n-H$ *1 | 10 | | | | | | | |
| 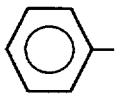 $-O-(CH_2CH_2O)_n-H$ n = 1 *2 | | 10 | | | | | | |
| 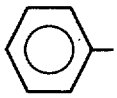 $-O-(CH_2CH_2O)_n-H$ n = 2 *3 | | | 10 | | | | | |

TABLE 1-continued

| | Example | Comparative Example No. | | | | | | |
|---|---|---|---|---|---|---|---|---|
| | 1 | 1 | 2 | 3 | 4 | 5 | 6 | 7 |
| 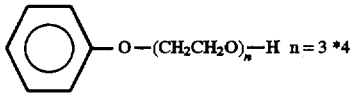 O—$(CH_2CH_2O)_n$—H n = 3 *4 | | | | 10 | | | | |
| 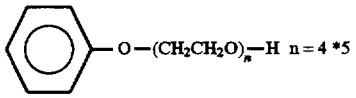 O—$(CH_2CH_2O)_n$—H n = 4 *5 | | | | | 10 | | | |
| 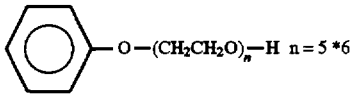 O—$(CH_2CH_2O)_n$—H n = 5 *6 | | | | | | 10 | | |
| 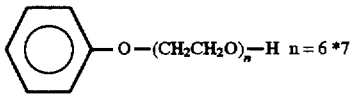 O—$(CH_2CH_2O)_n$—H n = 6 *7 | | | | | | | 10 | |
| Butyl carbitol | | | | | | | | 10 |
| Polyoxyethylene (p*8 = 7) lauryl ether | 2 | 2 | 2 | 2 | 2 | 2 | 2 | 2 |
| Monoethanolamine | 5 | 5 | 5 | 5 | 5 | 5 | 5 | 5 |
| Water | bal.*9 | bal. | bal. | bal. | bal. | bal. | bal. | bal. |
| Swell (Q) | 4.4 | 2.7 | 3.6 | 3.3 | 3.2 | 3.2 | 2.9 | 2.5 |

Note:
*1: A mixture having the following ethylene oxide (EO) distribution: EO 1 mol = 4 wt %; EO 2 mol = 27 wt %; EO 3 mol = 32 wt %; EO 4 mol = 22 wt %; EO 5 mol = 11 wt %; EO 6 mol = 4 wt %
*2: Commercially available reagent of first grade, produced by Kanto Chemical Co., Ltd.
*3: Hisolve DHP, produced by Toho Chemical Industry Co., Ltd.
*4 and *5: Obtained by adding ethylene oxide to phenol and purified by distillation.
*6: Synthesized by tosylating the hydroxyl group of the compound wherein n = 2 and reacting it with HO—$CH_2CH_2$—O—$CH_2CH_2$—O—$CH_2CH_2$—OH by refluxing in dioxane in the presence of sodium hydroxide.
*7: Synthesized by tosylating the hydroxyl group of the compound wherein n = 2 and reacting it with HO—$CH_2CH_2$—O—$CH_2CH_2$—O—$CH_2CH_2$—O—$CH_2CH_2$—OH by refluxing in dioxane in the presence of sodium hydroxide.
*8: Average degree of polymerization.
*9: Balance

EXAMPLES 2 TO 4 AND COMPARATIVE EXAMPLES 8 TO 9

A detergent composition having the composition shown in Table 2 below (unit: wt %) was prepared and subjected to a swelling test in the same manner as in Example 1. Further, the detergency and foaming properties of the composition were evaluated according to the following test methods. The results obtained are shown in Table 2.

Detergency Test:

Frying oil was uniformly applied to an iron plate and baked at 180° C. for 10 hours to prepare a plate with an almost dried film as a dirt model for a detergency test. The detergent composition was dropped on the vertically set plate with a dirt model and allowed to stand for 40 seconds. The released and floated dirt was lightly wiped off with absorbent wadding, and the degree of cleansing (detergency) was observed with the naked eye and rated according to the following standard.

A . . . The dirt was completely removed.
B . . . About 80% of the dirt was removed.
C . . . About 60% of the dirt was removed.
D . . . About 50% of the dirt was removed.
E . . . About 30% of the dirt was removed.
F . . . Dirt was not removed at all.

Test of Foaming Properties:

The detergent composition was sprayed onto a windowpane by means of a commercially available sprayer. The lather formed on spraying was visually observed and rated as follows.

A . . . Good lather.
B . . . Slight lather.
C . . . No lather.

TABLE 2

| | Example 2 | Example 3 | Example 4 | Compara. Example 8 | Compara. Example 9 |
|---|---|---|---|---|---|
| Component (a): | | | | | |
| Formula (I)*1: | | | | | |
| S*2 | 6.6 | 7.5 | 8.1 | | 0.7 |
| N*3 | 3.4 | 2.5 | 1.9 | | 9.3 |
| Component (b): | | | | | |
| Monoethanolamine | 5 | | 5 | 5 | |
| Diethanolamine | | 5 | | | 5 |
| Component (c): | | | | | |
| Polyoxyethylene lauryl ether | | | | 3 | |

TABLE 2-continued

| | Example 2 | Example 3 | Example 4 | Compara. Example 8 | Compara. Example 9 |
|---|---|---|---|---|---|
| (p*4 = 3) | | | | | |
| Dodecyl maltoside | 3 | 5 | | | |
| Lauryldimethyl-amine oxide | 1 | | | | |
| Sodium lauryl-benzenesulfonate | | | 3 | | |
| Sodium stearyl-sulfate | | | | | 5 |
| Ethanol | | | | 10 | |
| Water | bal.*5 | bal. | bal. | bal. | bal. |
| Evaluation: | | | | | |
| Detergency | A | A | B | F | C |
| Foaming Properties | A | A | A | C | B |
| Swell (Q) | 4.8 | 4.5 | 4.1 | 2.0 | 3.0 |

Note:
*1: A mixture having ethylene oxide distribution shown in Table 3.
*2: $\sum_{t=1}^{t=3} N_t$
*3: $\sum_{t=4}^{t=5} N_t$
*4: Average degree of polymerization.
*5: Balance

TABLE 3

| | Example No. 2 | Example No. 3 | Example No. 4 | Comparative Example No. 8 | Comparative Example No. 9 |
|---|---|---|---|---|---|
| 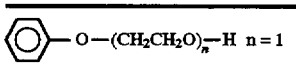 n = 1 | 1.29 | 1.56 | 1.9 | | |
| 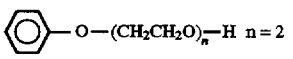 n = 2 | 1.7 | 2.04 | 4.2 | | |
| 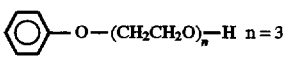 n = 3 | 3.61 | 3.9 | 2.0 | | 0.7 |
| 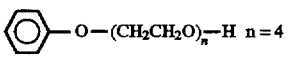 n = 4 | 1.82 | 1.6 | 1.01 | | 2.25 |
| 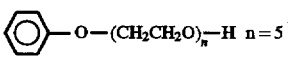 n = 5 | 0.98 | 0.7 | 0.89 | | 6.2 |
| 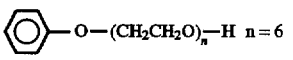 n = 6 | 0.6 | 0.2 | | | 0.85 |

It can be seen from the above results that the hard surface detergent composition of the present invention is excellent in swelling properties and detergency for oily dirt. In addition, the hard surface detergent composition was proved capable of rapid cleansing.

As described and demonstrated above, the hard surface detergent composition comprising component (a) has excellent swelling properties and detergent action on dirt difficult to remove, such as oil having denatured under the influences of temperature, humidity, oxygen, etc. and is capable of rapid cleansing.

In particular, the hard surface detergent composition comprising components (a) to (d) at a specific ratio shows further improvements.

The hard surface detergent composition of the present invention is particularly useful for removing denatured oily dirt.

While the invention has been described in detail and with reference to specific examples thereof, it will be apparent to one skilled in the art that various changes and modifications can be made therein without departing from the spirit and scope thereof.

We claim:

1. A detergent composition for hard surfaces containing (a) 0.1 to 30 parts by weight of a mixture consisting of compounds represented by formula (I) :

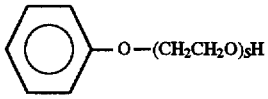

(I)

wherein s is an integer of from 1 to 10, representing the number of moles of the ethylene oxide group, which are different in degree of polymerization, said mixture (a) satisfying relationship (1):

$$99/1 \geqq \sum_{t=1}^{t=3} N_t / \sum_{t=4}^{t=6} N_t \geqq 15/85 \quad (1)$$

wherein $N_t$ is the percent by weight of a compound having t mol of the oxyethylene group added based on the weight of mixture (a), (b) 0.01 to 20 parts by weight of ammonia or an alkanolamine, and (c) 0.1 to 20 parts by weight of a surface active agent selected from the group consisting of an alkyl glycoside and an amine oxide; and wherein the said component (a) mixture of compounds contain ethoxylated phenols having mole numbers of addition of 4, 5 and 6.

2. A detergent composition for hard surfaces containing (a) from 0.1 to 30 parts by weight of a mixture consisting of compounds represented by formula (I):

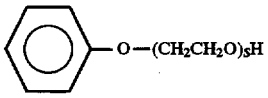

(I)

wherein s is an integer of from 1 to 10, representing the number of moles of the ethylene oxide group, which are different in degree of polymerization, said mixture (a) satisfying relationship (1):

$$99/1 \geqq \sum_{t=1}^{t=3} N_t / \sum_{t=4}^{t=6} N_t \geqq 15/85 \quad (1)$$

wherein $N_t$ is the percent by weight of a compound having t mol of the oxyethylene group added based on the weight of mixture (a), (b) from 0.01 to 20 parts by weight of an alkali agent, (c) from 0.1 to 20 parts by weight of at least one surface active agent selected from the group consisting of an alkyl glycoside and an amine oxide, and (d) water, each per 100 parts by weight of the total weight of components (a) to (d).

3. A detergent composition for hard surfaces as claimed in claim 2, wherein said detergent composition is for removal of denatured oily dirt.

4. A method for removing denatured oily dirt on hard surfaces using a detergent composition for hard surfaces claimed in claim 2.

5. The composition according to claim 1 wherein said alkyl glycoside is represented by the formula:

$$R_2(OR_3)_xG_y \quad (II)$$

wherein $R_2$ represents an alkyl group, an alkenyl group or an alkylphenyl group each having from 8 to 18 carbon atoms, the alkyl moiety of which may be straight or branched; $R_3$ represents an alkylene group having form 2 to 4 carbon atoms; G represents a residue or a reducing sugar having from 5 to 7 carbon atoms; x represents a number of from 0 to 5 on the average; and y represents a number of from 1 to 10 on the average.

6. The composition according to claim 2 wherein said alkyl glycoside is represented by the formula:

$$R_2(OR_3)_xG_y \quad \text{(II)}$$

wherein $R_2$ represents an alkyl group, an alkenyl group or an alkylphenyl group each having from 8 to 18 carbon atoms, the alkyl moiety of which may be straight or branched; $R_3$ represents an alkylene group having form 2 to 4 carbon atoms; G represents a residue or a reducing sugar having from 5 to 7 carbon atoms; x represents a number of from 0 to 5 on the average; and y represents a number of from 1 to 10 on the average.

* * * * *